US008816998B2

(12) United States Patent
Pyon et al.

(10) Patent No.: US 8,816,998 B2
(45) Date of Patent: Aug. 26, 2014

(54) ORGANIC LIGHT EMITTING DISPLAY

(75) Inventors: Chang-Soo Pyon, Yongin (KR); Won-Kyu Kwak, Yongin (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 135 days.

(21) Appl. No.: 13/242,316

(22) Filed: Sep. 23, 2011

(65) Prior Publication Data

US 2012/0313903 A1 Dec. 13, 2012

(30) Foreign Application Priority Data

Jun. 10, 2011 (KR) ..... 10-2011-0055877

(51) Int. Cl.
*G09G 5/00* (2006.01)
*G09G 3/32* (2006.01)

(52) U.S. Cl.
CPC ... *G09G 3/32* (2013.01); *G09G 5/00* (2013.01)
USPC ..... 345/204; 345/690; 345/76

(58) Field of Classification Search
CPC ..... G09G 3/3233; G09G 3/30; G09G 3/3208
USPC ..... 345/76–82, 204, 690
See application file for complete search history.

(56) References Cited

U.S. PATENT DOCUMENTS 5,952,789 A * 9/1999 Stewart et al. ..... 315/169.4
7,535,447 B2 * 5/2009 Kwak et al. ..... 345/87
7,542,019 B2 * 6/2009 Park et al. ..... 345/82
7,557,783 B2 * 7/2009 Kim ..... 345/82
7,557,784 B2 * 7/2009 Kwak et al. ..... 345/82
7,679,587 B2 * 3/2010 Kwak ..... 345/82
7,855,700 B2 * 12/2010 Kim et al. ..... 345/77

(Continued)

FOREIGN PATENT DOCUMENTS

EP 1679687 A2 * 7/2006 ..... G09G 3/32
EP 1764772 A2 * 3/2007 ..... G09G 3/32

(Continued)

OTHER PUBLICATIONS

Improve OLED Technology for Display by Jennifer Y. Yu, Ph.D Dissertation, Massachusetts Institute of Technology, Sep. 2008, 151 pages.*

(Continued)

*Primary Examiner* — Quan-Zhen Wang
*Assistant Examiner* — Chun-Nan Lin
(74) *Attorney, Agent, or Firm* — Knobbe, Martens, Olsen & Bear, LLP

(57) ABSTRACT

An organic light emitting display is disclosed. In one embodiment, the display includes pixels formed in every horizontal line, scan lines coupled to the pixels positioned in two horizontal lines, i data lines coupled to pixels positioned in odd horizontal lines, (i+1) data lines coupled to pixels positioned in even horizontal lines, and first and second emission control lines coupled to the pixels positioned in the two horizontal lines to supply first and second emission control signals, respectively. Each of the pixels includes a pixel circuit coupled to one of the data lines and one of the scan lines, a first organic light emitting diode (OLED) and a second OLED coupled to the pixel circuit to emit light to correspond to current supplied from the pixel circuit, and a selection unit for supplying current from the pixel circuit to the first or second OLED.

12 Claims, 4 Drawing Sheets

(56) References Cited

U.S. PATENT DOCUMENTS

| | | | | |
|---|---|---|---|---|
| 7,880,698 | B2 * | 2/2011 | Park et al. | 345/82 |
| 7,884,786 | B2 * | 2/2011 | Kim et al. | 345/83 |
| 7,888,860 | B2 * | 2/2011 | Sung et al. | 313/504 |
| 7,898,166 | B2 * | 3/2011 | Ohtani | 313/500 |
| 8,004,480 | B2 * | 8/2011 | Kim et al. | 345/82 |
| 8,059,140 | B2 * | 11/2011 | Kwon et al. | 345/690 |
| 8,063,852 | B2 * | 11/2011 | Kwak et al. | 345/76 |
| 8,076,674 | B2 * | 12/2011 | Kwak | 257/79 |
| 8,125,475 | B2 * | 2/2012 | Choi | 345/208 |
| 8,289,234 | B2 * | 10/2012 | Kim | 345/76 |
| 8,319,761 | B2 * | 11/2012 | Lee et al. | 345/204 |
| 8,427,403 | B2 * | 4/2013 | Shin | 345/79 |
| 8,432,335 | B2 * | 4/2013 | Kim | 345/76 |
| 2003/0214469 | A1 * | 11/2003 | Kageyama et al. | 345/82 |
| 2004/0070557 | A1 * | 4/2004 | Asano et al. | 345/76 |
| 2006/0071884 | A1 * | 4/2006 | Kim | 345/76 |
| 2006/0097965 | A1 * | 5/2006 | Deane et al. | 345/76 |
| 2006/0124944 | A1 * | 6/2006 | Kwak | 257/96 |
| 2006/0125807 | A1 * | 6/2006 | Park et al. | 345/204 |
| 2006/0132668 | A1 * | 6/2006 | Park et al. | 349/48 |
| 2006/0139257 | A1 * | 6/2006 | Kwak et al. | 345/76 |
| 2006/0220942 | A1 * | 10/2006 | Choi et al. | 341/172 |
| 2006/0262130 | A1 * | 11/2006 | Kim et al. | 345/589 |
| 2007/0057877 | A1 * | 3/2007 | Choi et al. | 345/76 |
| 2007/0242016 | A1 * | 10/2007 | Choi | 345/92 |
| 2008/0036704 | A1 * | 2/2008 | Kim et al. | 345/76 |
| 2010/0026669 | A1 * | 2/2010 | Lee et al. | 345/204 |
| 2011/0025678 | A1 * | 2/2011 | Chung | 345/213 |

FOREIGN PATENT DOCUMENTS

| | | | | |
|---|---|---|---|---|
| KR | 10-2006-0056785 | A | 5/2006 | |
| KR | 10-2007-0102861 | A | 10/2007 | |
| KR | 10-2008-0014331 | A | 2/2008 | |
| KR | 2008014331 | * | 2/2008 | G09G 3/20 |
| KR | 10-2010-0083017 | A | 7/2010 | |

OTHER PUBLICATIONS

Pixel Circuits and Driving Schemes for Active-Matrix Organic Light-Emitting Diode Displays by Shahin Jafarabadiashtiani, Ph.D dissertation, 2007 University of Waterloo, Electrical and Computer Engineering, 124 pages.*

Thin Film Transistor Integration for Biomedical Imaging and AMOLED Display by Reza Chaji, Ph.D Dissertation, University of Waterloo, 2008, 177 pages.*

* cited by examiner

ORGANIC LIGHT EMITTING DISPLAY

CROSS-REFERENCE TO RELATED APPLICATIONS

This application claims priority to and the benefit of Korean Patent Application No. 10-2011-0055877, filed on Jun. 10, 2011, in the Korean Intellectual Property Office, the entire content of which is incorporated herein by reference.

BACKGROUND

1. Field

The described technology generally relates to an organic light emitting display, and more particularly, to an organic light emitting display capable of improving display quality.

2. Description of the Related Technology

Recently, various flat panel displays (FPD) have been developed so as to reduce weight and volume that are disadvantages of cathode ray tubes (CRT). FPDs generally include a liquid crystal display (LCD), a field emission display (FED), a plasma display panel (PDP), and an organic light emitting display.

Among the FPDs, organic light emitting displays produce an image using organic light emitting diodes (OLED) that generate light by re-combination of electrons and holes. They generally have high response speed and consume low power. A typical OLED display supplies currents corresponding to data signals to OLEDs using transistors formed in pixels so that light is generated by the OLEDs.

SUMMARY

One inventive aspect is an organic light emitting display capable of improving an aperture ratio and display quality.

Another aspect is an organic light emitting display, including pixels formed in every horizontal line, scan lines coupled to the pixels positioned in two horizontal lines, i (i is an odd or even number) data lines coupled to pixels positioned in odd horizontal lines, (i+1) data lines coupled to pixels positioned in even horizontal lines, first emission control lines coupled to the pixels positioned in the two horizontal lines to supply a first emission control signal, and second emission control lines coupled to the pixels position in the two horizontal lines to supply a second emission control signal. Each of the pixels includes a pixel circuit coupled to one of the data lines and one of the scan lines, a first organic light emitting diode (OLED) and a second OLED coupled to the pixel circuit to emit light to correspond to current supplied from the pixel circuit, and a selecting unit for supplying current from the pixel circuit to the first OLED or the second OLED to correspond to the first and second emission control signals.

The selecting unit includes a first transistor coupled between the pixel circuit and the first OLED and turned on when the first emission control signal is supplied and a second transistor coupled between the pixel circuit and the second OLED and turned on when the second emission control signal is supplied. The organic light emitting display further includes a scan driver for sequentially supplying scan signals to the scan lines, for sequentially supplying the first emission control signal to the first emission control lines, and for sequentially supplying the second emission control signal to the second emission control lines and a data driver for supplying data signals to the data lines.

The scan driver supplies an emission control signal to a jth first emission control line after a scan signal is supplied to a jth (j is a natural number) scan line in a kth (k is a natural number) frame period. An emission control signal is supplied to a (j+1)th second emission control line after a scan signal is supplied to the jth scan line in a (k+1)th frame period. A first emission control signal supplied to the jth first emission control line and a second emission control signal supplied to the jth second emission control line are set to have a width not to overlap the scan signal supplied to the jth scan line.

The data driver supplies data signals corresponding to the odd horizontal lines to the i data lines in synchronization with the scan signals and supplies data signals corresponding to the even horizontal lines to the (i+1) data lines. The organic light emitting display further includes demultiplexers coupled to output lines of the data driver and a plurality of data lines. Each of the demultiplexers includes a plurality of switching elements coupled between the plurality of data lines and the output lines. The plurality of switching elements sequentially couple the output lines to the plurality of data lines while being sequentially turned on by control signals supplied from a timing controller. The data driver supplies a plurality of data signals to the output lines in synchronization with the control signals. The control signals do not overlap the scan signals and are supplied before the scan signals are supplied.

In the organic light emitting display according to the present invention, one scan line supplies scan signals to pixels positioned in two horizontal lines so that the width of the scan signals may be set to be large. As described above, when the width of the scan signals is set to be large, a data writing period may be sufficiently secured so that display quality may be improved.

BRIEF DESCRIPTION OF THE DRAWINGS

The accompanying drawings, together with the specification, illustrate certain embodiments.

DETAILED DESCRIPTION

Figure 1:
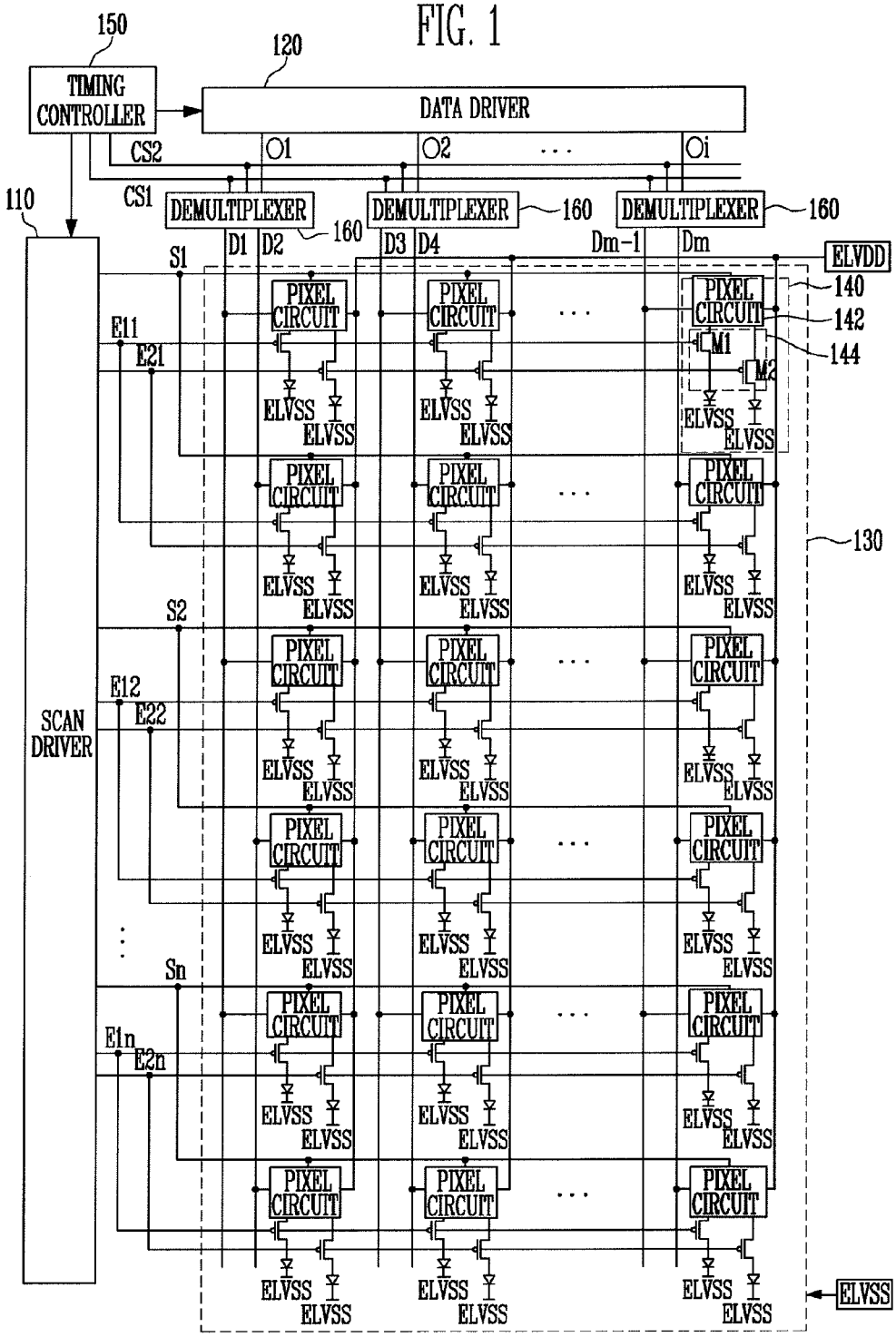
FIG. 1 is a view illustrating an organic light emitting display according to an embodiment.

An organic light emitting diode (OLED) display generally includes a data driver for supplying the data signals to data lines, a scan driver for sequentially supplying scan signals to scan lines, and a pixel unit including a plurality of pixels coupled to the scan lines and the data lines.

A pixel includes a pixel circuit selected when a scan signal is supplied to receive a data signal from a data line and an OLED that generates light to correspond to the amount of current supplied from the pixel circuit. The pixel circuit supplies the current corresponding to the data signal to the OLED while maintaining the data signal in one frame. The OLED generates light corresponding to the amount of current supplied thereto.

In order to improve an aperture ratio, a structure in which two OLEDs are coupled to one pixel circuit was suggested. In this case, the pixel circuit divides a frame period to supply predetermined current to the OLEDs coupled thereto.

Therefore, the pixel circuit receives a plurality of data signals to correspond to a plurality of OLEDs in one frame period. However, in order to supply the data signals to the plurality of pixel circuits in one frame period, a data writing period (that is, a scan signal supplying period) is reduced so that display quality deteriorates.

Hereinafter, embodiments will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the disclosed embodiments are omitted for clarity. Also, like reference numerals refer to like elements throughout.

Embodiments will be described with reference to FIGS. 1 to 5 such that those skilled in the art can easily understand.

FIG. 1 is a view illustrating an organic light emitting display according to an embodiment.

Referring to FIG. 1, the organic light emitting display includes a pixel unit 130 including pixels 140 positioned at the intersections of scan lines S1 to Sn and data lines D1 to Dm, a scan driver 110 for driving the scan lines S1 to Sn, first emission control lines E11 to E1*n*, and second emission control lines E21 to E2*n*, a data driver 120 for driving data lines D1 to Dm, demultiplexers 160 coupled to the output lines O1 to Oi of the data driver 120, and a timing controller 150 for controlling the scan driver 110, the data driver 120, and the demultiplexers 160.

In one embodiment, each of the scan lines S1 to Sn is coupled to the pixels 140 positioned in two horizontal lines. The two horizontal lines may be or may not be consecutive to each other. This applies to at least one other embodiment. That is, the first scan line S1 is coupled to the pixels 140 positioned in first and second horizontal lines and the second scan line S2 is coupled to the pixels 140 positioned in third and fourth horizontal lines. The scan lines S1 to Sn supply scan signals to the pixels 140 positioned in the two horizontal lines.

In one embodiment, each of the first emission control lines E11 to E1*n* and the second emission control lines E21 to E2*n* is coupled to the pixels 140 positioned in the two horizontal lines. That is, the first emission control lines E11 and E21 are coupled to the pixels 140 positioned in the first and second horizontal lines and the second emission control lines E12 and E22 are coupled to the pixels 140 positioned in the third and fourth horizontal lines.

The scan driver 110 sequentially supplies the scan signals to the scan lines S1 to Sn. Then, the scan driver 110 sequentially supplies a first emission control signal to the first emission control lines E11 to E1*n* and sequentially supplies a second emission control signal to the second emission control lines E21 to E2*n*.

Here, the first emission control signal is sequentially supplied in an odd (or even) frame period and the second emission control signal is sequentially supplied in the even (or odd) frame period. For example, the first emission control signal is supplied to a jth (j is a natural number) first emission control line E1*j* after a scan signal is supplied to a jth scan line Sj in a kth (k is a natural number) frame period and the second emission control signal is supplied to a jth second emission control line E2*j* in a (k+1)th frame period after the scan signal is supplied to the jth scan line Sj. On the other hand, the scan signal, the first emission control signal, and the second emission control signal are set to have voltages at which transistors are turned on.

In some embodiments, the first emission control signal and the second emission control signal are alternately supplied to each frame. In another embodiment, one frame is divided into two fields and the first emission control signal and the second emission control signal may be alternately supplied to each field.

The demultiplexers 160 are coupled to the output lines O1 to Oi. The demultiplexers 160 are coupled to the data lines. Then, for convenience sake, it is assumed that each of the demultiplexers 160 is coupled to the two data lines. The demultiplexer 160 transmits the two data signals supplied to an output line (one of O1 to Oi) to the two data lines.

Figure 2:
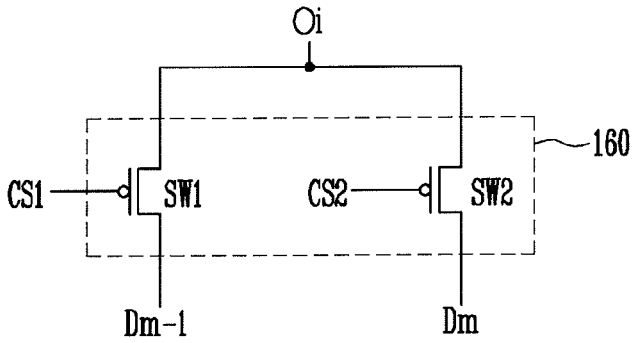
FIG. 2 is a view illustrating the demultiplexer of FIG. 1.

Therefore, as illustrated in FIG. 2, the demultiplexer 160 includes a first switching element SW1 and a second switching element SW2. The first switching element SW1 transmits the data signal turned on when a first control signal CS1 is supplied from the timing controller 150 to be supplied to the output line Oi to an (m−1)th data line Dm−1. The second switching element SW2 transmits the data signal turned on when a second control signal CS2 is supplied from the timing controller 150 to be supplied to the output line Oi to the mth data line Dm.

In one embodiment, the first control signal CS1 and the second control signal CS2 are sequentially supplied not to overlap with the scan signals. For example, the first control signal CS1 and the second control signal CS2 are supplied before the scan signals are supplied and are set to have a smaller width than the scan signals.

In one embodiment, odd data lines D1, D3, . . . , and Dm−1 are coupled to the pixels 140 (that is, pixel circuits) positioned in odd horizontal lines. The odd data lines D1, D3, . . . , and Dm−1 receive the data signals from the output lines O1 to Oi when the first control signal CS1 is supplied.

In one embodiment, even data lines D2, D4, . . . , and Dm are coupled to the pixels 140 (that is, pixel circuits) positioned in even horizontal lines. The even data lines D2, D4, . . . , and Dm receive the data signals from the output lines O1 to Oi when the second control signal CS2 is supplied.

In another embodiment, the odd data lines D1, D3, . . . , and Dm−1 are coupled to the pixels 140 positioned in the even horizontal lines and the even data lines D2, D4, . . . , and Dm may be coupled to the pixels 140 positioned in the odd horizontal lines. Various coupling types may be adopted so that adjacent data lines are coupled to the pixels 140 positioned in different horizontal lines.

The data driver 120 supplies two data signals to each of the output lines O1 to Oi in synchronization with the first control signal CS1 and the second control signal CS2. In this case, the two data signals supplied to each of the output lines O1 to Oi are supplied to the two data lines coupled to the demultiplexer 160.

The pixel unit 130 includes the pixels 140 positioned at the intersections of the scan lines S1 to Sn and the data lines D1 to Dm. the pixels 140 receive a first power source ELVDD and a second power source ELVSS. The pixels 140 control the amount of current supplied from the first power source ELVDD to the second power source ELVSS via organic light emitting diodes OLED1 and OLED2 to correspond to the data signals.

In one embodiment, each of the pixels 140 includes a pixel circuit 142, a selection unit 144, a first OLED (OLED1), and a second OLED (OLED2).

The pixel circuit 142 receives a data signal from a data line (one of D1 to Dm) when a scan signal is supplied to a scan line (one of S1 to Sn) and supplies the current corresponding to the received data signal to the selection unit 144. The pixel circuit 142 may have currently well-known various types.

On the other hand, the pixel circuits 142 positioned in the odd horizontal lines are coupled to the odd data lines D1, D3, . . . , and Dm−1 and the pixel circuits 142 positioned in the even horizontal lines are coupled to the even data lines D2, D4, . . . , and Dm.

The anode electrode of OLED1 is coupled to the selection unit 144 and the cathode electrode of OLED1 is coupled to the second power source ELVSS. OLED1 generates light with predetermined brightness to correspond to the current supplied from the pixel circuit 142 via the selection unit 144.

The anode electrode of OLED2 is coupled to the selection unit 144 and the cathode electrode of OLED2 is coupled to the second power source ELVSS. OLED2 generates light with predetermined brightness to correspond to the current supplied from the pixel circuit 142 via the selection unit 144.

The selection unit 144 supplies the current supplied from the pixel circuit 142 to OLED1 or OLED2. Therefore, the selection unit 144 includes a first transistor M1 coupled between OLED 1 and the pixel circuit 142 and a second transistor M2 coupled between OLED2 and the pixel circuit 142.

The first transistor M1 is turned on when the first emission control signal is supplied to a first emission control line (one of E11 to E1*n*) and the second transistor M2 is turned on when the second emission control signal is supplied to a second emission control line (one of E21 to E2*n*). In this case, the turning on time of the first transistor M1 does not overlap with the turning on time of the second transistor M2. Therefore, OLED1 and OLED2 alternately emit light.

In one embodiment, the two OLEDs (OLED 1 and OLED2) are coupled to the selection unit 144. In another embodiment, more than two OLEDs are coupled to the selection unit 144.

Figure 3:
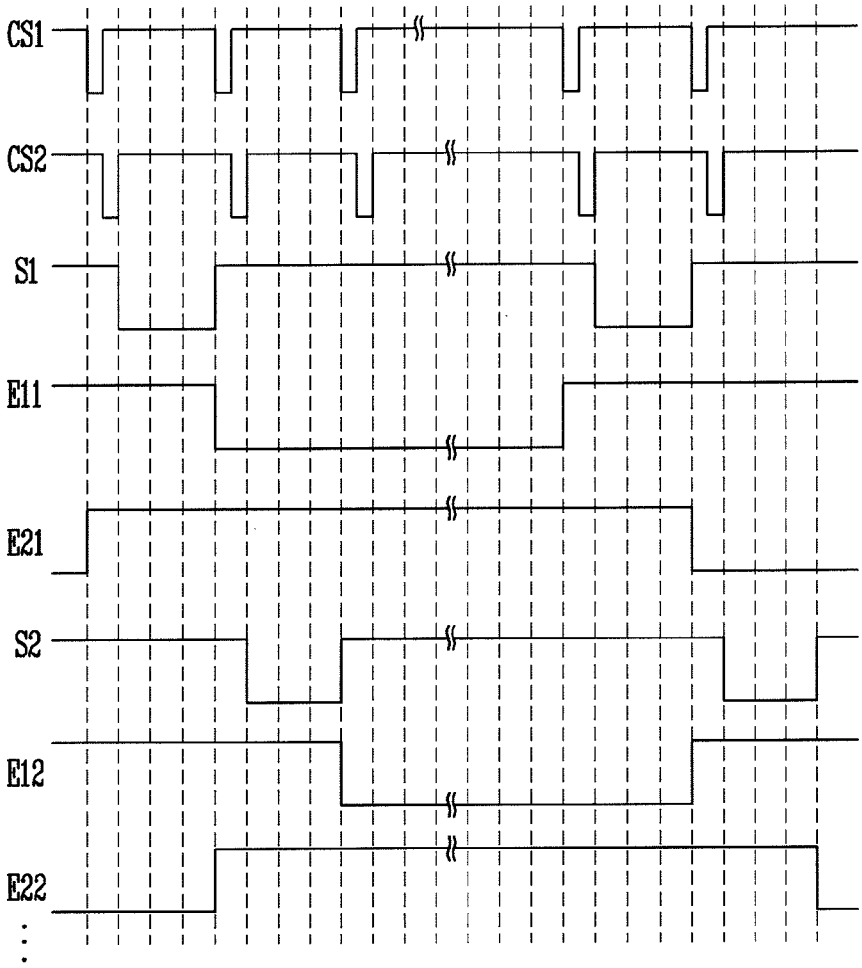
FIG. 3 is a waveform chart illustrating a method of driving the organic light emitting display of FIG. 1.

FIG. 3 is a waveform chart illustrating a method of driving the organic light emitting display of FIG. 1.

Referring to FIG. 3, the first control signal CS1 and the second control signal CS2 are sequentially supplied before a scan signal is supplied to the first scan line S1.

When the first control signal CS1 is supplied, the first switching element SW1 included in each of the demultiplexers 160 is turned on. When the first switching element SW1 is turned on, the data signals supplied to the output lines O1 to Oi are supplied to the data lines D1, D3, . . . , and Dm−1 via the first switching element SW1.

When the second control signal CS2 is supplied, the second switching element SW2 included in each of the demultiplexers 160 is turned on. When the second switching element SW2 is turned on, the data signals supplied to the output lines O1 to Oi are supplied to the data lines D2, D4, . . . , and Dm via the second switching element SW2.

On the other hand, the data signals supplied to the data lines D1 to Dm are charged in the parasitic capacitors of the data lines D1 to Dm. The parasitic capacitors of the data lines D1 to Dm are set to have higher capacity than the capacitors included in the pixels 140 so that the data signals may be stably stored.

Then, the scan signal is supplied to the first scan line S1. When the scan signal is supplied to the first scan line S1, the pixel circuits positioned in the first and second horizontal lines are selected. At this time, the data signals stored in the parasitic capacitors of the odd data lines D1, D3, . . . , and Dm−1 are supplied to the pixel circuits positioned in the first horizontal line and the data signals stored in the parasitic capacitors of the even data lines D2, D4, . . . , and Dm are supplied to the pixel circuits positioned in the second horizontal line.

Then, the first emission control signal is supplied to the first emission control line E11 so that a first transistor M1 positioned in the first and second horizontal lines is turned on. When the first transistor M1 is turned on, the current supplied from the pixel circuit 142 is supplied to OLED1 so that OLED1 emits light with predetermined brightness in one frame period.

The second to nth scan lines S2 to Sn repeat the above processes so that OLED1 included in the pixel unit 130 emit light in one frame period.

In the next frame period, scan signals are sequentially supplied to the first to nth scan lines S1 to Sn. Then, in the next frame period, the second emission control signal is sequentially supplied to the second emission control lines E21 to E2*n*. When the second emission control signal is supplied, the second transistor M2 is turned on so that the current supplied from the pixel circuit 142 is supplied to OLED2.

In one embodiment, since one pixel circuit 142 controls the two OLEDs (OLED1 and OLED2), it is possible to increase an aperture ratio. In addition, since the scan lines S1 to Sn supply scan signals to the pixels 140 positioned in the two horizontal lines, one scan signal may be supplied in a period where the scan signals are supplied in two horizontal periods.

Figure 4:
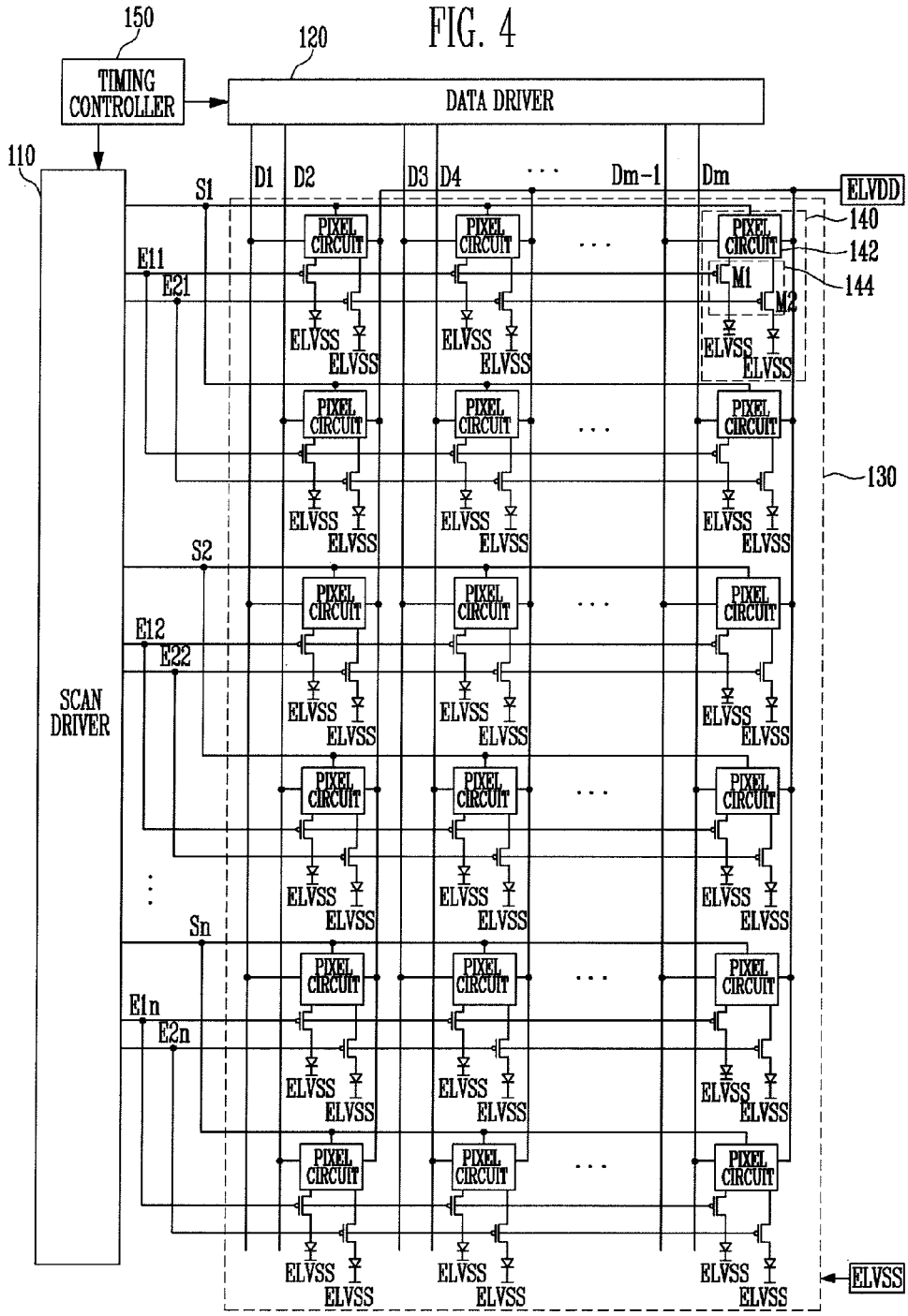
FIG. 4 is a view illustrating an organic light emitting display according to another embodiment.

FIG. 4 is a view illustrating an organic light emitting display according to another embodiment. In FIG. 4, the same elements as those of FIG. 1 are denoted by the same reference numerals and detailed description thereof will be omitted.

Referring to FIG. 4, the demultiplexers 160 are removed in comparison with the organic light emitting display of FIG. 1. In this case, the data lines D1 to Dm are directly coupled to the data driver 120.

The data driver 120 directly coupled to the data lines D1 to Dm supplies the data signals in synchronization with the scan signals. The data signals corresponding to the odd horizontal lines are supplied to the odd data lines D1, D3, . . . , and Dm−1 and the data signals corresponding to the even horizontal lines are supplied to the even data lines D2, D4, . . . , and Dm.

Since the other structures are the same as the organic light emitting display of FIG. 1, detailed description thereof will be omitted.

Figure 5:
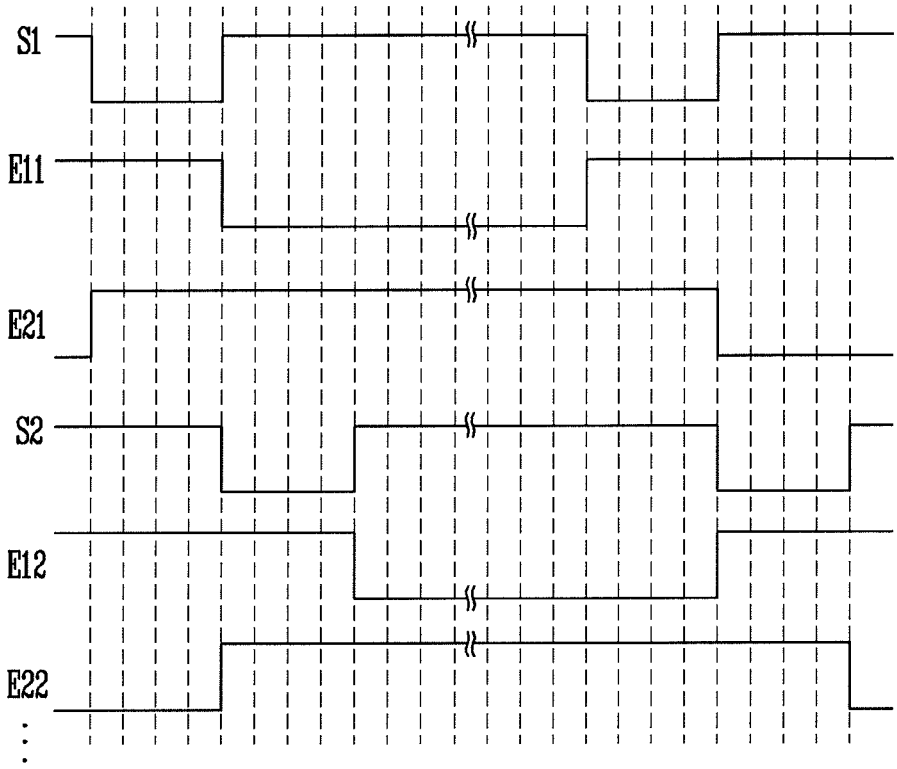
FIG. 5 is a waveform chart illustrating a method of driving the organic light emitting display of FIG. 4.

FIG. 5 is a waveform chart illustrating a method of driving the organic light emitting display of FIG. 4.

Referring to FIG. 5, a scan signal is supplied to the first scan line S1 and then, data signals are supplied to the data lines D1 to Dm in synchronization with the scan signals.

When the scan signal is supplied to the first scan line S1, the pixels 140 positioned in the first and second horizontal lines are selected. At this time, the data signals supplied to the odd data lines D1, D3, . . . , and Dm−1 are input to the pixels 140 positioned in the first horizontal line and the data signals supplied to the even data lines D2, D4, . . . , and Dm are input to the pixels 140 positioned in the second horizontal line.

Then, the first emission control signal is supplied to the first emission control line E11 so that the first transistor M1 positioned in the first and second horizontal lines is turned on. When the first transistor M1 is turned on, the current supplied from the pixel circuit 142 is supplied to OLED1 so that OLED1 emits light with predetermined brightness in one frame period.

Then, the scan signals are sequentially supplied to the second to nth scan lines S2 to Sn so that the data signals are supplied to the pixels 140. The first transistor M1 is sequentially turned on by the first emission control signal supplied to the first emission control lines E12 to E1*n* in units of the two horizontal lines so that light with predetermined brightness is generated by OLED1.

Then, in the next frame period, the scan signals are sequentially supplied to the first to nth scan lines S1 to Sn and the second emission control signal is sequentially supplied to the second emission control lines E21 to E2*n*. when the second emission control signal is sequentially supplied, the second transistor M2 is turned on in units of the two horizontal lines so that light with predetermined brightness is generated by OLED2.

While the disclosed embodiments have been described in connection with the accompanying drawings, it is to be understood that they are not considered limiting, but, on the contrary, are intended to cover various modifications and equivalent arrangements included within the spirit and scope of the appended claims, and equivalents thereof.

What is claimed is:

1. An organic light emitting display, comprising:
a plurality of pixels formed in every horizontal line;
a plurality of scan lines electrically connected to the pixels positioned in two horizontal lines;
i (i is an odd or even number) data lines electrically connected to pixels positioned in odd horizontal lines;
(i+1) data lines electrically connected to pixels positioned in even horizontal lines;
a plurality of first emission control lines each configured to supply a first emission control signal to control two neighboring rows of the pixels; and
a plurality of second emission control each configured to supply a second emission control signal to control two neighboring rows of the pixels, wherein each of the pixels comprises:
a pixel circuit electrically connected to one of the data lines and one of the scan lines;
a first organic light emitting diode (OLED) and a second OLED electrically connected to the pixel circuit to so as emit light based on current supplied from the pixel circuit; and
a selection unit configured to supply current from the pixel circuit to the first OLED or the second OLED based on the first and second emission control signals.

2. The organic light emitting display as claimed in claim 1, wherein the selection unit comprises:
a first transistor coupled between the pixel circuit and the first OLED and turned on when the first emission control signal is supplied; and
a second transistor coupled between the pixel circuit and the second OLED and turned on when the second emission control signal is supplied.

3. The organic light emitting display as claimed in claim 1, further comprising:
a scan driver configured to i) sequentially supply scan signals to the scan lines, ii) sequentially supply the first emission control signal to the first emission control lines, and iii) sequentially supply the second emission control signal to the second emission control lines; and
a data driver configured to supply data signals to the data lines.

4. The organic light emitting display as claimed in claim 3, wherein the scan driver is configured to supply an emission control signal to a jth first emission control line after a scan signal is supplied to a jth (j is a natural number) scan line in a kth (k is a natural number) frame period, and
wherein the scan driver is further configured to supply an emission control signal to a (j+1)th second emission control line after a scan signal is supplied to the jth scan line in a (k+1)th frame period.

5. The organic light emitting display as claimed in claim 4, wherein both a first emission control signal supplied to the jth first emission control line and a second emission control signal supplied to the jth second emission control line have a width which does not overlap with the scan signal supplied to the jth scan line.

6. The organic light emitting display as claimed in claim 3, wherein the data driver is configured to supply data signals corresponding to the odd horizontal lines to the i data lines in synchronization with the scan signals and supply data signals corresponding to the even horizontal lines to the (i+1) data lines.

7. The organic light emitting display as claimed in claim 3, further comprising a plurality of demultiplexers coupled to output lines of the data driver and a plurality of data lines.

8. The organic light emitting display as claimed in claim 7, wherein each of the demultiplexers comprises a plurality of switching elements coupled between the data lines and the output lines.

9. The organic light emitting display as claimed in claim 7, wherein the switching elements are configured to sequentially couple the output lines to the data lines while being sequentially turned on by control signals supplied from a timing controller.

10. The organic light emitting display as claimed in claim 9, wherein the data driver is configured to supply a plurality of data signals to the output lines in synchronization with the control signals.

11. The organic light emitting display as claimed in claim 9, wherein the control signals do not overlap with the scan signals and wherein the timing controller is configured to supply the control signals before the scan signals are supplied.

12. An organic light emitting display, comprising:
a plurality of pixels formed in every horizontal line, the pixels comprising first pixels positioned in odd horizontal lines and second pixels positioned in even horizontal lines;
a plurality of scan lines electrically connected to the first pixels and the second pixels;
i (i is an odd or even number) data lines electrically connected to the first pixels;
(i+1) data lines electrically connected to the second pixels;
a plurality of first emission control lines each configured to supply a first emission control signal to control two neighboring rows of the pixels; and
a plurality of second emission control lines each configured to supply a second emission control signal to control two neighboring rows of the pixels, wherein each of the pixels comprises:
a pixel circuit electrically connected to one of the data lines and one of the scan lines;
a first organic light emitting diode (OLED) and a second OLED electrically connected to the pixel circuit to so as emit light based on current supplied from the pixel circuit; and
a selection unit configured to supply current from the pixel circuit to the first OLED or the second OLED based on the first and second emission control signals.

* * * * *